US005365888A

United States Patent [19]

Aronov

[11] Patent Number: 5,365,888

[45] Date of Patent: Nov. 22, 1994

[54] FLUID HEATER AND METHOD

[75] Inventor: Michael A. Aronov, Mayfield Heights, Ohio

[73] Assignee: Gas Research Institute, Chicago, Ill.

[21] Appl. No.: 100,471

[22] Filed: Aug. 2, 1993

[51] Int. Cl.[5] ..... F22B 5/02

[52] U.S. Cl. ..... 122/19; 122/250 R; 122/248; 122/367.1

[58] Field of Search ..... 122/14, 18, 19, 249, 122/250 R, 250 S, 248-251, 367.1-367.3

[56] References Cited

U.S. PATENT DOCUMENTS

| | | | |
|---|---|---|---|
| 200,482 | 2/1878 | Salisbury | 122/249 |
| 548,941 | 10/1895 | Wilder | 122/250 R |
| 1,133,364 | 3/1915 | Junkers | 122/367.3 |
| 1,883,733 | 10/1932 | Hahn | 122/367.3 |
| 1,983,170 | 12/1934 | Hanna | 122/19 |
| 2,223,856 | 12/1940 | Price | 122/250 R |
| 3,534,712 | 10/1970 | Reynolds | 122/225 |
| 4,338,888 | 7/1982 | Gerstmann et al. | 122/16 |
| 4,444,155 | 4/1984 | Charron et al | 122/19 |
| 4,453,498 | 6/1984 | Juhasz | 122/136 R |
| 4,473,034 | 9/1984 | Raudabaugh et al. | 122/18 |
| 4,617,820 | 10/1986 | Hirano et al. | 110/323 |
| 4,679,528 | 7/1987 | Krans et al. | 122/367 |
| 4,723,513 | 2/1988 | Vallett et al. | 122/19 |
| 4,793,800 | 12/1988 | Vallett et al. | 431/328 |

*Primary Examiner*—Henry A. Bennet
*Assistant Examiner*—William C. Doerrler
*Attorney, Agent, or Firm*—Pearne, Gordon, McCoy & Granger

[57] ABSTRACT

A fluid heater and method are disclosed for heating a heat transfer fluid flowing within a heater tube using reradiative and convective heat transfer while avoiding direct flame impingement on the heater tube. The heater tube is separated from the flame by a heat shield that cools the flame temperature and reradiates heat energy to the heater tube. The combustion products are directed around the shield and into contact with the heater tube.

21 Claims, 1 Drawing Sheet

FLUID HEATER AND METHOD

BACKGROUND OF INVENTION AND RELATED ART

This invention relates to heat exchanger apparatus and methods for transfer of heat to fluids and, more particularly, to a fluid heater apparatus and method of heating heat transfer fluids. The invention is described below with particular reference to heat transfer fluid applications.

Heat transfer fluids are heated to desired working temperatures for transfer of process heat in a wide range of industrial applications such as indirect heating of process liquids and polymers, heating and cooling in batch processing, energy generation and recovery processes, drying and heating bulk materials and gas processing. Typical industrial applications include textile, chemical, energy and hydrocarbon processing. These heat transfer fluids are typically useful in temperature ranges between about 350° to about 800° F. There are two types of fluids, the so called hot oils derived from petroleum and synthetic fluids such as aromatic fluids sold under the designation DOWTHERM by The Dow Chemical Company.

When exposed to high temperatures, such heat transfer fluids undergo physical and chemical changes that shorten the useful fluid life and result in a loss of useable fluid. Such thermal degradation of the fluids may also reduce the heat transfer efficiency and system safety while at the same time increasing operating costs and downtime.

The heat transfer fluids are typically heated as they flow through heater or heating tubes of a heat exchanger apparatus. In such cases, the liquid flow within the heater tube is characterized by a temperature profile that includes a relatively higher film temperature at radially outward regions in the heater tube and a relatively lower bulk fluid temperature at radially inward regions adjacent the central core region of the tube. The film temperature may be 50° to 75° F. higher than the bulk fluid temperature.

The relatively higher film temperature tends to limit the designed upper heating temperature and heat flux transfer in such heating apparatus and applications. More particularly, the possibility of heat flux variations and associated higher operating temperatures require a buffer or safety range between the designed operating temperature and the upper thermal limit of the heat transfer fluid. For similar reasons, it is desirable that the heater tube not be directly impinged by a heating flame since this may result in local fluid temperature increases of several hundred degrees Fahrenheit and sometimes leave a deposit on the interior wall of the heater tube. Such deposits decrease the heat transfer and lower the heat transfer efficiency.

The foregoing difficulties in maintaining a design operating temperature substantially at or near the upper thermal limit of the heat transfer fluid are further complicated in a heating application requiring a turn down capability. In such cases, the required safety margin for heat transfer at high operating temperature conditions may result in an extremely inefficient or slow response at low operating temperature conditions.

It is also desirable that the heat exchanger be compact since it will often comprise an ancillary device or a component of a more comprehensive apparatus. Thus, it is not desirable to merely extend the Spatial arrangement of the heating flame and the heater tube with variable flame operation along the extent of the tube to accommodate turn down. Similarly, the prior art use of excess air to suppress flame temperatures, reduced BTU input rates, shorter flame lengths and/or separate combustion chambers are not satisfactory techniques for avoiding thermal degradation of the heat transfer fluid since such techniques also result in increased heat exchanger size and inefficient operation and decreased response times also result.

Heating apparatus including a central heat flame and a surrounding heater tube array is disclosed in U.S. Pat. Nos. 4,793,800, 4,723,513, 4,473,034, 4,444,155 and 4,338,888. U.S. Pat. No. 4,679,528 discloses a heating boiler having a central heating flame and a surrounding coil heater tube. The products of combustion pass radially through the heater tube coil, and are discharged through an axially extending vent.

SUMMARY OF THE INVENTION

It has now been discovered that reradiative and convective heat transfer may be used in combination to efficiently transfer heat to a fluid with relatively low levels of heat flux and correspondingly low flame temperatures in order to suppress and/or avoid excess fluid temperatures and, in the case of heat transfer fluids, thermal degradation of the heat transfer fluid. The heat transfer apparatus and process are characterized by a uniformity of heat flux distribution and lower maximum operating temperatures that enable the use of a heater tube having fins to further enhance heat transfer.

In accordance with the invention, an apparatus and method are provided for transfer of heat to a heat transfer fluid using a central burner flame, a surrounding heater tube array containing fluid to be heated and a heat shield or barrier judiciously positioned between the flame and heater tube array. The heat shield reduces the maximum flame temperature and reradiates thermal energy to the tube array while preventing direct flame impingement and contact. The flow of hot products of combustion from the flame is subsequently directed around the heat shield into direct contact with the heater tube array for convective heat transfer therewith.

The uniformity of the heat flux distribution and lower maximum operating flame temperature enable the use of a heater tube array having fins to further enhance the heat transfer. In the absence of the heat shield to reduce heat flux and temperature as well as direct flame impingement, conventional finned heater tube coil arrangements will be damaged and/or induce hot spots at which the temperature exceeds the thermal degradation temperature of the heat transfer fluid. Thus, an important aspect of the invention is the realization that a temperature reducing and thermal energy reradiating heat shield avoids extremes in the amount of heat flux transferred to the heater tube and the corresponding temperature extremes so as to enable the use of a finned tube array to enhance heat transfer at lower temperatures and thereby better maintain a relatively high overall heat transfer efficiency.

An important aspect of the invention is the achievement of a relatively compact heat exchanger or fluid heater apparatus. Compactness is achieved by recognition that a net decrease in the heat exchanger size may be effected by the trade off between (1) the decrease in heat exchanger size due to an increase in heat transfer with the use of a finned heater tube array and (2) the increase in heat exchanger size due to the lower more uniform heat flux and correspondingly lower temperature difference driving the transfer of heat. In other words, from the view point of relative heat exchanger size, the benefits in total heat transfer achieved by the use of reradiation and fins exceed the losses in heat transfer due to lower heat flux and flame temperature, and thereby enable compactness.

DETAILED DESCRIPTION OF THE DRAWINGS

Figure 1:
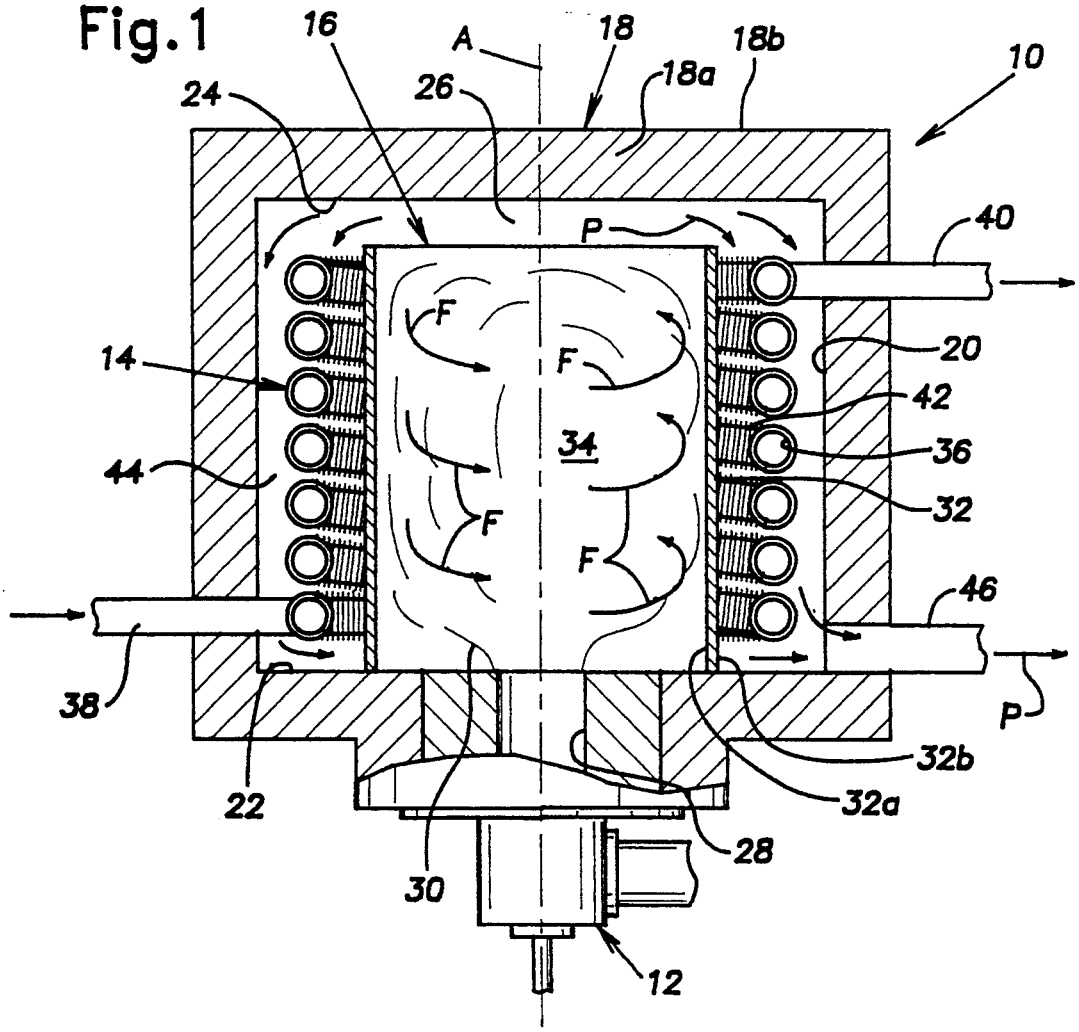
FIG. 1 is a schematic elevation view, partly in section, of a heat exchanger apparatus for heating a heat transfer fluid in accordance with the invention.

Referring to FIG. 1, a heat exchanger or fluid heater apparatus 10 includes as its main elements or components a burner 12, a heater tube array 14 and a heat shield or barrier 16 mounted within a housing 18. The housing 18 may be heat insulated with a suitable material such as fibrous insulation 18*a* and enclosed within a metallic cabinet wall 18*b*.

The housing 18 has a generally cylindrical shape extending about a longitudinal axis "A". The housing 18 includes a sidewall 20 which is closed at its opposite ends by a proximal end wall 22 and a distal end wall 24. The walls 20, 22 and 24 cooperate to define a substantially closed combustion and heat transfer chamber 26. The walls 20, 22 and 24 may be formed of a suitable heat resistant metal such as 304 stainless steel.

The burner 12 is mounted adjacent the proximal end wall 22 of the housing 18. The burner 12 comprises a powered burner arranged to burn a supplied fuel such as natural gas. The burner 12 includes a nozzle arrangement 28 adapted to provide a flame 30 extending along the longitudinal axis "A" of the housing 18. The burner 12 is preferably a swirl flame burner that provides the flame 30 with a swirl pattern as indicated by the arrows "F". The flame 30 should contact the heat shield 16 along a major portion or substantially all of its longitudinal length, but the flame 30 should not impinge upon the distal end wall 24 of the housing 18, and preferably should not extend beyond the longitudinal length of the heat shield 16.

The burner 12 should be sized for the particular heating application, and typical heater input ratings may range from about 50,000 to about 500,000 Btu/hour.

The heat shield 16 has a generally cylindrical shape, and it is concentrically disposed about the longitudinal axis "A" within the housing 18. The heat shield 16 comprises a relatively thin wall 32 formed into an open-ended cylinder having an inner wall surface 32*a* and an outer wall surface 32*b*. The heat shield wall 32 is continuous and substantially imperforate, and it may be formed of a suitable flame shielding and reradiating material such as 304 stainless steel.

The heat shield wall 32 surrounds the burner nozzle 28 and substantially restricts or confines the flame 30 so as to prevent flame impingement of and/or contact with the heater tube array 14. To that end, the heat shield 16, and more particularly the wall surface 32*a* thereof, provides a conduit shaped, flame receiving region 34 surface 32*a*. The heat shield 16 and wall 32 are arranged to provide the region 34 with sufficiently large dimensions to enhance radiation heat transfer to the wall surface 32*a* since radiation is proportional to the length of the radiation beam. For example, the region 34 may be about 12 inches long and have a diameter of about 9.5 inches to provide a region volume of about 850 in.$^3$ for a burner 12 having a rating of 150,000 Btu/hour. During operation, the wall 32 is heated to a red glowing temperature with the highest wall temperatures adjacent the proximal end of the wall.

The heater tube array 14 has a cylindrical coil configuration including a heat transfer tube 36 arranged in a spiral pattern around the heat shield 16. The tube 36 has an inlet end connected to fluid inlet 38 and an outlet end connected to fluid outlet 40. The fluid inlet 38 is positioned adjacent the proximal end wall 22 of the housing 18 and the fluid outlet is positioned adjacent the distal end wall 24 of the housing 18 so that the fluid flows in a generally upward direction (as shown in FIG. 1) toward the distal end wall 24 of the housing 18.

The tube 36 includes fins 42 radially extending from the exterior tube surface for enhancing convective heat transfer to fluid flowing within the tube. The fins 42 may be integrally formed with the tube 36 or subsequently applied thereto. The cross-section of the tube 36 may have an outside diameter of about 0.75 inches and an outside fin diameter of about 0.875 inches. In the illustrated embodiment, a total of about 12 wraps of the tube 36 about the heat shield 16 are used to provide a heat exchange area of about 1550 in.$^2$ or 10.76 ft.$^2$ The tube 36 and the fins 42 may be formed of 304 stainless steel as an integral construction, and satisfactory finned tubes are commercially available.

The coil formed by the tube 36 is centrally positioned with an annular passageway 44 formed between the outer shield wall surface 32*b* and the sidewall 20 of the housing 18. The passageway 44 is sized to receive the coil of the tube 36 with about 0.125 inches of clearance on each side of the adjacent extremities of the fins 42. (For clarity of illustration, the clearance is exaggerated in FIG. 1.)

The distal end wall 24 operates to direct the hot products of combustion from the region 34 around the distal end of the wall 32 and into the passageway 44 for direct contact and convective heat transfer with the heater tube array 14 as shown by the arrows "P". A vent 46 is provided adjacent the proximal end of the passageway 44 for discharge of combustion products from the chamber 26 to the atmosphere.

The tube array 16 is heated by reradiation of thermal energy from the outer wall surface 34*b* and convective counter current heat transfer from the products of combustion as they contact the tube 36 and fins 42 during flow through the passageway 44.

In the illustrated embodiment, the heat exchanger apparatus or fluid heater 10 has a generally cylindrical shape, the housing 18 being about 15.5 inches in diameter and 13 inches long. The combustion and heat transfer chamber 26 is centrally disposed in the housing 18 about the longitudinal axis "A" and it has a diameter of about 11.5 inches and a length of about 13 inches. The burner 12 is mounted to the proximal end of the housing 18.

The heat shield 16 and tube 36 are concentrically mounted about the longitudinal axis "A" of the housing 18. The heat shield 16 or wall 32 has a diameter of about 9.5 inches and a length of about 12 inches. The distal end of the heat shield 16 is spaced about one inch from the distal end wall 24 of the housing 18.

The annular passageway 44 defined between the outside wall surface 32b and housing sidewall 20 has a radial dimension of about 1.125 inches. The tube 36 wrapped with fins 42 has a diameter of about 0.875 inches. Assuming the cross-sectional area of the tube 36 and fins 42 to block the fluid flow through the passageway 44, the available flow area through the passageway 44 is about 8.13 in.$^2$ In comparison, the flow area through the region 26 is about 67.17 in.$^2$ so that the reduction of flow area is in a ratio of about 8:1, that is the flow area is reduced by about 88%. This reduction of flow area substantially accelerates the combustion products passing from the region 34 through the passageway 44 and thereby increases the coefficient of heat transfer and the amount of heat transferred to the fluid flowing within the tube 36.

The heat exchange apparatus 10 was used to heat Dowtherm J heat transfer fluid from an inlet temperature in the range of from about 300° to 450° F. to an outlet temperature of from about 450° to about 465° F. in a single pass through the apparatus at flow rates of from about 3.5 to about 8.0 gal/min. The maximum heat transfer fluid film temperature is 650° F. In this application the burner 12 is operated at a maximum fuel input of 125,000 Btu/hour with a turn down ratio of 1 to 5 to accommodate varying thermal energy requirements as determined by the required fluid temperature increase and fluid flow rate. The hydraulic resistance to the flow of the thermal fluid is about 4.2 psi, and the pressure drop of the combustion products is about 1" $H_2O$. The foregoing applications were achieved with no significant thermal degradation of the heat transfer fluid. Further, a thermal efficiency of about 80% was attained without condensation of the products of combustion.

Figure 2:
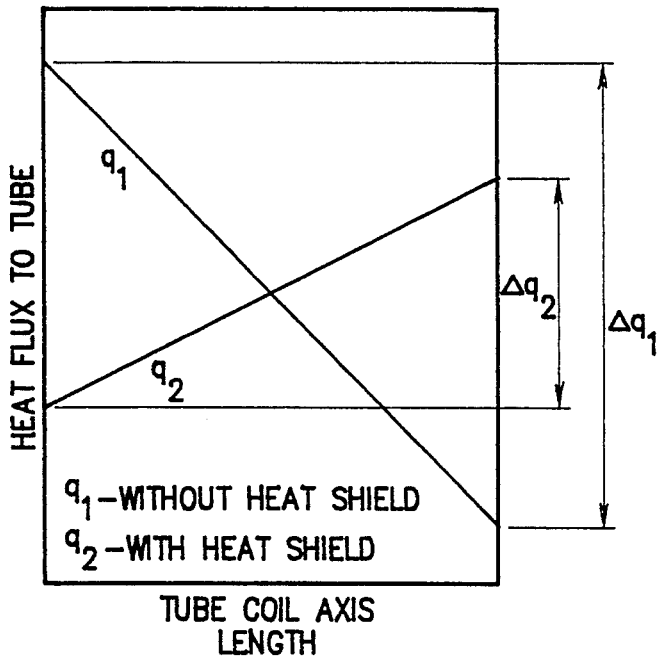
FIG. 2 is a graph showing the distribution of heat flux to the heater tube array of the heat exchanger apparatus of FIG. 1.

Referring to FIG. 2, a comparison of the heat flux to the heat transfer tube 36 with and without the use of a heat shield 16 in the fluid heater 10 is graphically shown. As indicated, the elimination of the heat shield 16 results in significantly higher and lower levels of heat flux and temperature extremes at spaced locations along the length of the tube axis. The higher heat flux locations give rise to an increased risk of thermal degradation of the heat transfer fluid due to the higher temperatures associated with such higher heat flux levels. The lower levels of heat flux resulting without the use of the shield may be considered to be unacceptable, less efficient locations of heat transfer as compared with the lowest levels of heat flux attained with the use of the heat shield. Accordingly, the use of the heat shield 16 results in a more uniform heat flux distribution characterized by a decreased risk of thermal degradation and relatively acceptable levels of heat transfer efficiency at all locations along the axial length of the tube 36.

What is claimed is:

1. A fluid heater for heating a fluid, said fluid heater having a longitudinal axis extending from a proximal end to a distal end thereof, a housing having a housing sidewall extending along said axis to a housing distal end wall adjacent the distal end of the fluid heater, a powered burner for emitting a flame and products of combustion for heating said fluid, said flame having a flame length extending along said axis, a heat shield having inner shield and outer shield wall surfaces extending along said axis from said burner to a location spaced from said housing distal end wall, said inner shield wall surface providing a conduit shape flame region, and a heating tube for containing a flow of fluid, said heating tube having an axial length extending between said heat shield and housing sidewall, said outer shield wall surface and housing sidewall cooperating to define a passageway containing said heating tube, said burner being mounted adjacent a proximal end of said heat shield with said inner shield wall surface being arranged to confine said burner flame within said flame region along substantially all of said flame length to prevent impingement of the flame on the heating tube and to direct the flow of products of combustion along said axis, said housing distal end wall directing the flow of products of combustion from said flame region around the distal end of said heat shield and into said passageway for direct contact with said heating tube, said passageway being sized to increase the flow velocity of said products of combustion and the heat transfer coefficient upon contact with said heating tube for increasing the convective heat transfer to fluid passing through the heating coil, said inner shield wall surface being arranged to absorb heat from said flame and products of combustion along at least a major portion of its entire length and said outer shield wall surface being arranged to reradiate heat along at least a major portion of its entire length to said heating tube, whereby the temperature of said products of combustion is sufficiently decreased as said products of combustion flow through said flame region to enable direct contact with said heating tube without degradation of the fluid.

2. The heater of claim 1, wherein said heating tube is a heating coil arranged in a spiraled cylindrical configuration surrounding said outer shield wall surface and said heating coil includes radially extending fins to enhance heat transfer.

3. The heater of claim 2, wherein said heat shield and heating coil are disposed in a common combustion and heat transfer chamber provided by said housing walls.

4. The heater of claim 3, wherein said heat shield has a cylindrical shape.

5. The heater of claim 4, wherein said heat shield flame region has a flow area greater than the flow area of said passageway, said flame region being relatively large to enhance radiative heat transfer and said passageway being relatively small to enhance convective heat transfer.

6. The heater of claim 5, wherein the ratio of the flow areas of said heat shield flame region and passageway is about 8 to 1.

7. The heater of claim 5, wherein said heat shield has an axial length substantially equal to the length of the flame, said housing has an axial length sufficiently greater than that of said shield to turn said products of combustion towards said heating tube, and the distance between said heating coil and outer shield wall surface is minimized.

8. The heater of claim 7, wherein said fluid is a heat transfer fluid.

9. A fluid heater for heating a heat transfer fluid, said fluid heater having a longitudinal axis extending from a proximal end to a distal end thereof, a housing having a housing sidewall extending along said axis to a housing distal end wall adjacent the distal end of the fluid heater, a powered burner for emitting a flame and products of combustion for heating said heat transfer fluid, said flame having a flame length extending along said axis, a heat shield having inner shield and outer shield wall surfaces extending along said axis from said burner to a location spaced from said housing distal end wall, said inner shield wall surface providing a conduit shape flame region, and a heating tube for containing a flow of heat transfer fluid, said heating tube being disposed between said heat shield and housing sidewall, said outer shield wall surface and housing sidewall cooperating to define a passageway containing said heating tube, said burner being mounted adjacent a proximal end of said heat shield conduit with said inner shield surface being arranged to confine said burner flame within said flame region along substantially all of said flame length to prevent impingement of the flame on the heating tube and to direct the flow of products of combustion along said axis, said housing distal end wall directing the flow of products of combustion from said flame region around the distal end of said heat shield and into said passageway for direct contact with said heating tube, said passageway being sized to increase the flow velocity of said products of combustion and the heat transfer coefficient upon contact with said heating tube for increasing the convective heat transfer to fluid passing through the heating coil, said inner shield wall surface being arranged to absorb heat along substantially its entire length and said outer shield wall surface being arranged to reradiate heat along at least substantially its entire length to said heating tube, and whereby temperature of said products of combustion is sufficiently decreased as said products of combustion flow through said flame region to enable direct contact with said heating tube without degradation of the heat transfer fluid.

10. A method of heating a fluid flowing through a fluid heater having a longitudinal flow axis extending from a proximal end to a distal end thereof, a housing having a housing sidewall, a powered burner, a heat shield having inner shield and outer shield wall surfaces extending along said axis from said burner, said inner shield wall surface providing a conduit shape flame region, and a heating tube disposed within a passageway between said heat shield and housing sidewall, comprising the steps of operating said burner adjacent a proximal end of said heat shield to impinge a burner flame on said inner shield wall surface and direct the flow of products of combustion along said axis, directing the flow of products of combustion from said flame region around the distal end of said heat shield and into said passageway for direct contact with said heating tube, increasing the flow velocity of said products of combustion and the heat transfer coefficient upon contact with said heating coil and absorbing heat along at least a major portion of the axial extent of said inner shield wall surface and reradiating heat from at least a major portion of the axial extent of said outer shield wall surface to said heating coil to thereby increase the uniformity of the heat flux distribution along the axis of the fluid heater.

11. The method of claim 10, wherein said heat shield lowers the maximum flame temperature and prevents direct flame impingement of said heating tube and thereby enables the use of fins on said heating tube.

12. The method of claim 10, wherein said heating tube is a heating coil arranged in a spiraled cylindrical configuration surrounding said outer shield wall surface.

13. The method of claim 12, wherein said heat shield and heating coil are disposed in a common combustion and heat transfer chamber provided by said housing walls.

14. The method of claim 13, wherein said heat shield has a cylindrical shape.

15. The method of claim 14, wherein said heat shield has a flow area greater than the flow area of said passageway.

16. The method of claim 15, wherein the ratio of the flow areas of said heat shield flame region and passageway is about 8 to 1.

17. The method of claim 16, wherein said heat shield conduit has an axial length substantially equal to the length of the flame, said housing has an axial length of sufficiently greater than that of said shield to turn said products of combustion towards said heating tube, and the distance between said heating coil and outer shield wall surface is minimized.

18. A method of heating an organic heat transfer fluid to a desired bulk fluid temperature comprising passing said fluid through a heating coil for indirect heat transfer with the hot products of combustion issuing from a powered burner having a flame temperature exceeding said maximum bulk fluid temperature, confining said coil within a housing having a burner axis along which said burner is arranged to issue its flame and products of combustion, obstructing direct impingement of said flame issuing from said burner on said heating coil by disposing a shield therebetween, reducing the temperature of said flame and products of combustion by radiative and convective heat transfer to said shield, reradiating heat from said shield to said heating coil, directing said relatively cooler products of combustion around said shield and into a passageway defined by said housing and shield, said passageway containing said coil and being sized to accelerate the flow of said products of combustion and thereby increase the heat transfer coefficient upon contact with said coil for increasing the convective heat transfer to said fluid passing within said coil, and withdrawing said products of combustion from said passageway following contact with said coil.

19. A method as in claim 18, wherein said fluid has a thermal degradation temperature and a film temperature as it passes through said coil which exceeds its bulk temperature, and including the further step of selecting said burner flame temperature so that the film temperature of the fluid passing through the coil would exceed the thermal degradation temperature of the fluid in the absence of said shield.

20. The heater of claim 1, wherein said inner shield wall surface is arranged to absorb heat from said flame and products of combustion along substantially its entire length and said outer shield wall surface is arranged to reradiate heat along substantially its entire length to said heating tube.

21. The heater of claim 20, wherein said heat shield, heating tube and housing sidewall are concentrically arranged about said longitudinal axis, said burner having a nozzle arranged to emit said flame into the extremity of the proximal end of said heat shield, and said proximal and distal axial extremities of said heat shield, heating tube and flame are respectively disposed in substantially common planes.

* * * * *